US006311350B1

(12) United States Patent
Kaiserman et al.

(10) Patent No.: US 6,311,350 B1
(45) Date of Patent: Nov. 6, 2001

(54) INTERACTIVE FABRIC ARTICLE

(75) Inventors: Terrance Z. Kaiserman, Loxahatchee, FL (US); Keith J. Margolin, Gilbertsville, PA (US)

(73) Assignee: Ferber Technologies, L.L.C., East Newark, NJ (US)

( * ) Notice: Subject to any disclaimer, the term of this patent is extended or adjusted under 35 U.S.C. 154(b) by 0 days.

(21) Appl. No.: 09/372,903

(22) Filed: Aug. 12, 1999

(51) Int. Cl.[7] ..... F21L 15/08; A47G 9/10

(52) U.S. Cl. ..... 5/639; 5/636; 5/904; 174/257; 174/128.1; 362/103

(58) Field of Search ..... 5/636, 639, 904, 5/907

(56) References Cited

U.S. PATENT DOCUMENTS 4,862,438 * 8/1989 Fry ..... 5/639 X
5,072,429 * 12/1991 Mair ..... 5/639 X
5,371,326 * 12/1994 Clearwaters-Dreager et al. ..... 174/128.1
5,371,657 * 12/1994 Wiscombe ..... 362/103
5,455,749 10/1995 Ferber ..... 362/103
5,626,948 5/1997 Ferber et al. ..... 428/195
5,973,420 * 10/1999 Kaiserman et al. ..... 307/139
6,081,949 * 7/2000 Delicia ..... 5/904

* cited by examiner

*Primary Examiner*—Michael F. Trettel
(74) *Attorney, Agent, or Firm*—Lerner, David, Littenberg, Krumholz & Mentlik, LLP

(57) ABSTRACT

A fabric article including a design arranged on the outer surface of such fabric article and having conductive composition arranged in registration with the design and with a printed circuit pattern is disclosed. The conductive composition effectively forms part of the electrical system of the interactive fabric article.

31 Claims, 6 Drawing Sheets

INTERACTIVE FABRIC ARTICLE

FIELD OF THE INVENTION

The present invention relates to interactive fabric articles such as pillows, t-shirts and other fabric articles. More particularly, the present invention relates to interactive fabric articles having conductive composition used as a portion of a switch in an electrical system.

BACKGROUND OF THE INVENTION

Conductive compositions have been developed for various purposes including facilitating electrostatic discharge and as a current transfer medium on printed circuit boards. Recently, conductive compositions have been used, instead of conventional wires, as part of an electrical system for conducting current from a power source to various current operated circuit components on a variety of objects such as wearing apparel, children's toys and books.

Examples of desirable electrical systems that use conductive compositions are disclosed in U.S. Pat. Nos. 5,455,749 and 5,626,948. The '749 patent discloses electrical systems that include a power source, one or more circuit components such as an LED or a sound chip, and conductive composition for connecting the power source to the circuit components so that current generated by the power supply can be delivered to such circuit components. In one embodiment, the conductive composition may be colored. In another embodiment, the conductive composition may form at least a portion of a design arranged on an object. In yet another embodiment, the conductive composition is sufficiently durable to withstand multiple washes without cracking, substantial resistance build up or other failure.

The '948 patent also discloses the use of conductive compositions as part of an electrical system on toys, clothing and other articles. It is particularly directed toward a "vertically conductive" composition that forms part of an electrical system where current is permitted to flow in a direction normal to the surface of an object on which the conductive composition is arranged, but is not permitted to flow through and along the conductive composition in a direction parallel to the surface of the article on which the conductive composition is arranged. The vertically conductive composition of the '948 patent is particularly useful where colored conductive compositions are desired.

Although various efforts have been made to develop conductive compositions that can be used as part of an electrical system for consumer and industrial products, the prior art does not disclose, teach or suggest in any way that such conductive compositions can be used as part of a switch for fabric articles where such conductive composition is arranged in registration with a design on the surface of the fabric article. The present invention addresses the aforementioned shortcomings and needs of the prior art.

SUMMARY AND OBJECTS OF THE INVENTION

One aspect of the present invention relates to an interactive pillow comprising a first fabric portion having an outer surface and an inner surface. A design may be arranged on the outer surface of the first fabric portion. A substrate including a printed circuit pattern is preferably arranged inside the pillow and is normally spaced from the first fabric portion. A battery and a circuit component are connected to the printed circuit pattern of the substrate. Conductive composition is arranged between the inner surface of the first fabric portion and the printed circuit pattern in registration with both the design and the printed circuit pattern so that an external forced applied to the design will cause contact between the conductive composition and the printed circuit pattern. Such contact will permit current to flow from the battery through the printed circuit pattern to activate the circuit component.

In a preferred embodiment, the circuit component may comprise a sound chip. In another preferred embodiment, the circuit component may comprise a light emitting diode (LED). In still other preferred embodiments, the circuit component may comprise various additional active or inactive current operated modules including but not limited to integrated circuits, transmitters, capacitors, inductors, resistors, etc.

The substrate on which the printed circuit pattern is arranged may be made of natural or synthetic fabric, various polymers, fiberglass or other materials suitable to support a printed circuit pattern. In one preferred embodiment, the substrate comprise a second fabric portion normally spaced from the first fabric portion of the interactive pillow.

It is preferable for the conductive composition to comprise a conductive ink. However, other conductive compositions may be used in accordance with the present invention such as conductive paint, various conductive pastes and the like.

In one preferred embodiment, the conductive composition is arranged directly on the inner surface of the first fabric portion underlying the design on the outer surface thereof. In another preferred embodiment, the conductive composition is impregnated through the first fabric portion so that it is present on both the outer and inner surfaces thereof. In yet another preferred embodiment, the conductive composition is not directly arranged on the first fabric portion. Instead, it may be arranged on an insert placed between the inner surface of the first fabric portion and the printed circuit pattern of the substrate.

In the embodiment where an insert carrying the conductive composition is arranged between the inner surface of the first fabric portion and the printed circuit pattern of the substrate, such insert may comprise fabric, fiberglass, plastic or various other synthetic and naturally occurring materials.

The conductive composition may be substantially or entirely colorless. In other embodiments, the conductive composition may comprise a metallic color, may be substantially black, or may comprise various other colors without limitation.

The interactive pillow preferably comprises a spacing substrate arranged between the inner surface of the first fabric portion and the substrate carrying the printed circuit pattern. The spacing substrate may have one or more openings in registration with the conductive composition and a selected portion of the printed circuit pattern. The spacing substrate may comprise fabric. Alternatively, the spacing substrate may comprise cured nonconductive ink or various other substantially nonconductive materials that separate the conductive composition from the printed circuit pattern. In another embodiment, the printed circuit pattern on the substrate may also comprise a conductive composition.

In other preferred embodiments, the present invention may comprise fabric articles, other than interactive pillows, that have the same features as the pillow embodiment discussed above. Such fabric articles may comprise, for example, various types of clothing, furniture, toys, games and other articles.

Further features and advantages of the present invention will be apparent when considered in view of the following detailed description and drawings.

DETAILED DESCRIPTION OF THE PREFERRED EMBODIMENTS

Figure 1:
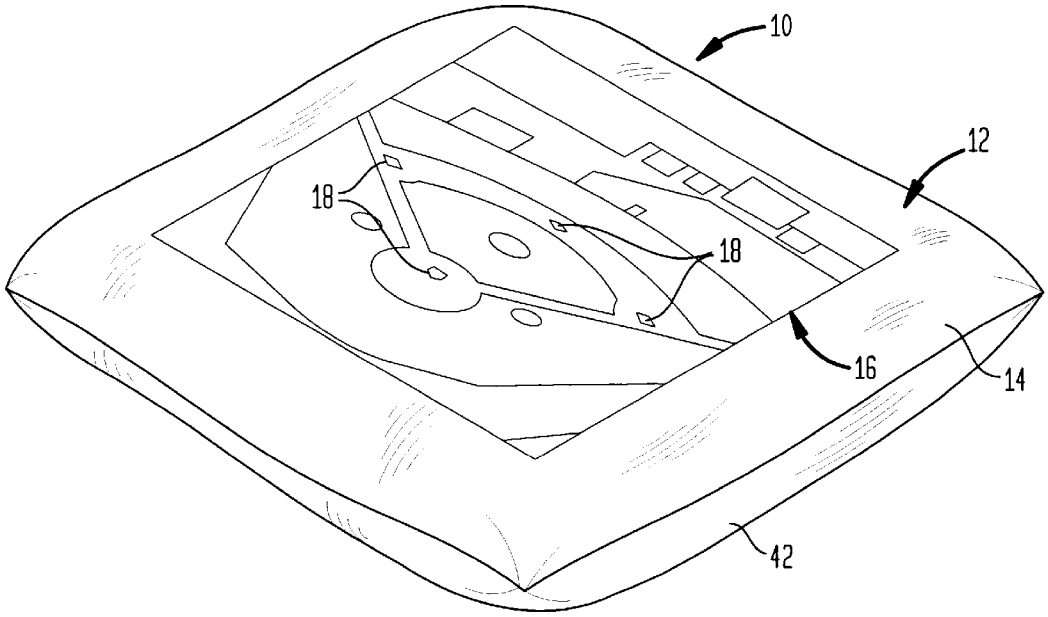
FIG. 1 is a perspective view of one embodiment of an interactive pillow in accordance with the present invention.

A preferred embodiment of an interactive fabric article, such as interactive pillow 10 is shown in FIGS. 1–4. The interactive pillow 10 includes a front fabric portion 12 (i.e., a first fabric portion) having an outer surface 14. The fabric can be made of various naturally occurring and synthetic materials. A preferred fabric for a pillow may comprise a blend of cotton and polyester. However, the present invention is not limited to any particular type of fabric. The fabric may be woven or non-woven and can have various textures.

As shown in FIGS. 1–4, the outer surface 14 of front fabric 12 includes the design of a baseball field 16. The design may be printed on the outer surface 14 or it may be embroidered thereon. Alternatively, the design 16 may be applied to the surface 14 by means other than printing or embroidery. For example, the design 16 may be applied to the surface 14 by heat transfer, embossing, hot stamping, applique techniques, etc. In an embodiment where the baseball field design 16 is printed on the fabric, the type of fabric used may be one known as a PFP fabric (i.e., a fabric having a "prepared for printing finish").

It should be appreciated that the design of a baseball field 16 was arbitrarily chosen as designs applied to fabric articles may vary infinitely while remaining within the scope of the present invention.

As is well known, the baseball field design 16 includes four bases (i.e., first, second, third and home) all designated by common reference numeral 18. As discussed below, the bases 18 are significant as they will serve as reference markers for a switch using conductive composition within the scope of the present invention.

Figure 2:
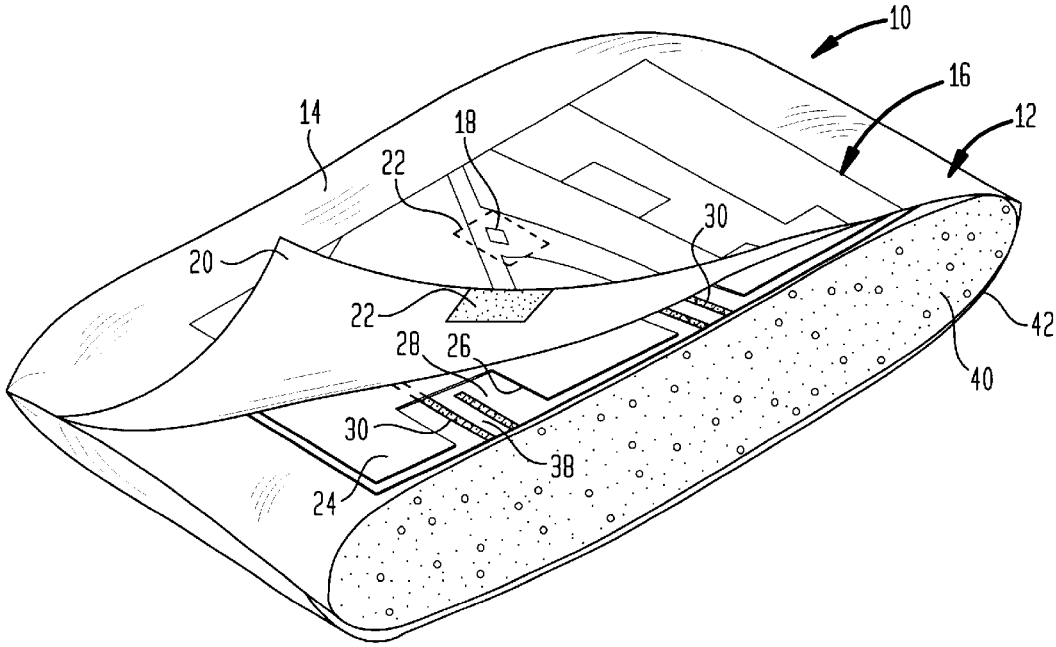
FIG. 2 is a partially cut away, cross sectional and peeled open view of the interactive pillow of FIG. 1.
Figure 3:
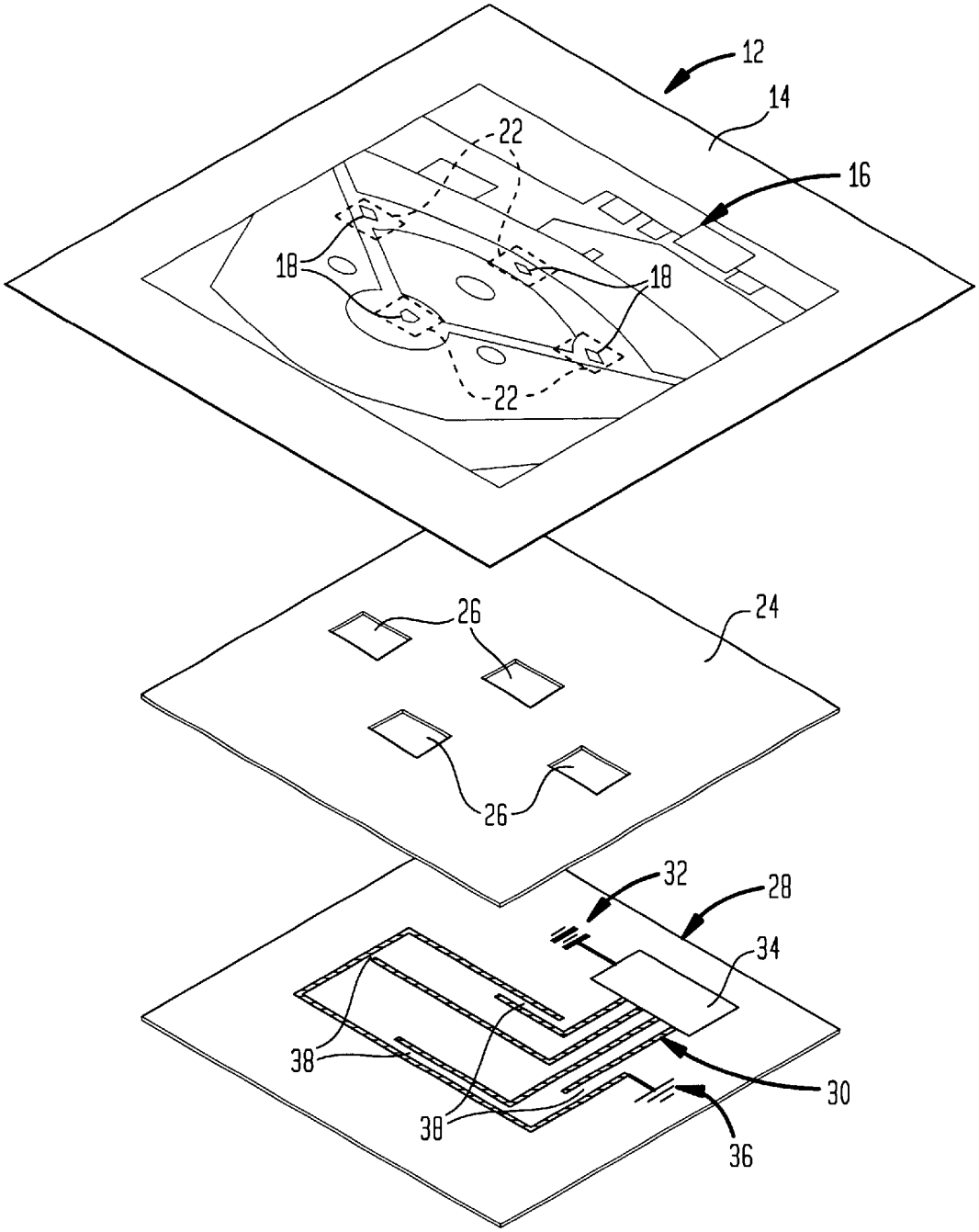
FIG. 3 is an exploded view of selected portions of the interactive pillow of FIG. 1.
Figure 4:
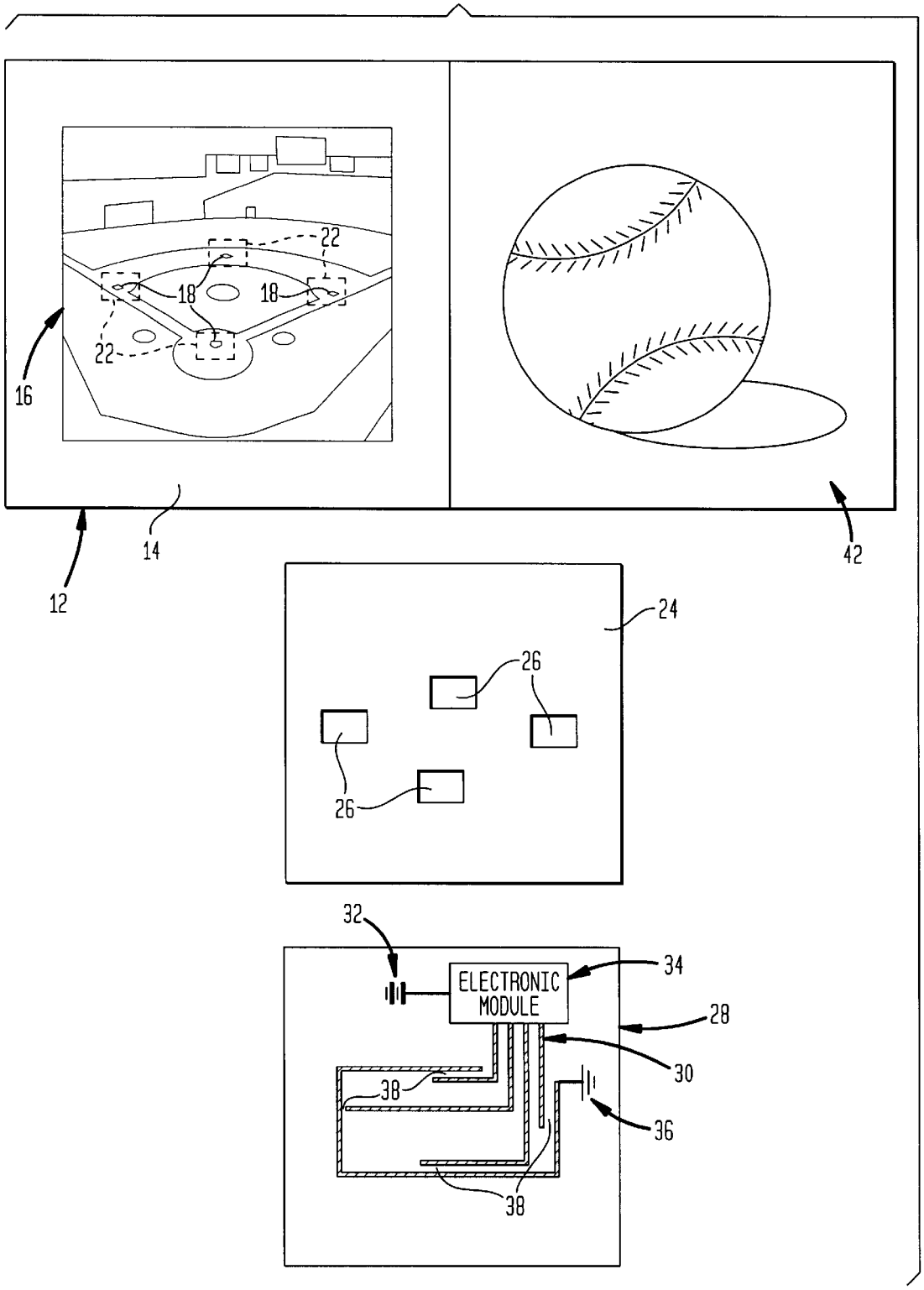
FIG. 4 is a top plan schematic view of selected portions of the interactive pillow of FIG. 1.

The first fabric portion 12 includes an inner surface 20, best shown in FIG. 2. In the embodiment of FIGS. 1–4, conductive composition 22 is applied directly to the inner surface 20 of the first fabric portion 12. FIGS. 2–4 illustrate that the conductive composition 22 is applied in direct registration (i.e., alignment) with corresponding bases 18. The conductive composition 22 is shown in the partially cut away and peeled open view of FIG. 2. As also shown in FIGS. 2–4, the conductive composition 22 underlying the bases 18 is represented by dotted lines, although the conductive composition represented by such dotted lines is actually beneath the bases 18 and is not shown directly.

The conductive composition 22 of the present invention may be of the type disclosed in U.S. Pat. Nos. 5,455,749 and 5,626,948, the disclosures of which are incorporated by reference herein.

In a preferred embodiment, the conductive compositions may comprise a resin and conductive materials. The resins may be any of the resins typically used for surface coatings. For example, suitable resins may comprise acrylamide, acrylics, phenolics, epoxies, shellac, carboxymethyl cellulose, cellulose acetate butyrate, cellulosics chlorinated polyether, chlorinated rubber, epoxy esthers, ethylene vinyl acetate copolymers, maleics, melamine, natural resins, nitrocellulose solutions, isocyanates, hydrogenated resin, polyamide, polycarbonate, rosins, polyesters, polyethylene, polyolefins, polypropylene, polystyrene, polyurethane, polyvinyl acetate, silicone, vinyls, and water thinned resins. Additional suitable resins are described in the text entitled 1996 *Paint Red Book*, published by Modern Paint and Coatings Magazine, July 1995. Further, the resins may include any other materials which have suitable binding properties to temporarily or permanently bind the conductive materials and other ingredients of the conductive composition.

The conductive materials should be consistent with desired properties of the conductive composition itself including its flexibility, washability, durability, conductivity and other desired properties. The conductive materials may be, but are not limited to, precious metals and non-precious metals such as base metal powders and flakes, inorganic powders coated with precious or base metals, graphite and elemental carbon powders, and various inorganic powders such as mica, $TiO_2$, silica, etc., coated with antimony doped tin oxide. Such powders need not be spherical or flake like, although they may be. For example, silver coated fiberglass particles can be used. Suitable non-precious metals include, but are not limited to iron, copper, brass, bronze, aluminum, nickel, carbon, graphite, antimony doped tin oxide, phosphor, bronze, zinc and the like. Various conductive polymers doped polyacetylene, doped polypyrrole, doped polythiophene, doped polyaniline and the like may also be used. It should be appreciated that other conductive materials besides those discussed herein may be used while remaining within the scope of the present invention, as there is no particular limitation on the type of conductive compositions that may be utilized.

The conductive composition of the present invention may also comprise a liquid in which the resin is dissolved or dispersed. Thus, the selected resins may be either water soluble or soluble in an organic solvent based system. Alternatively, the selected resin may be dispersible in a suitable liquid, rather than truly soluble therein. A liquid dispersion medium may be used in which a resin is dispersed, but in which other materials may be truly dissolved. Further, the resin may also be 100% solids (e.g., bulk materials that do not require any solvents). The resin may be used with or without crosslinking or catalyzation. If crosslinking is desired, it may be obtained by using a crosslinking agent or by application of heat to the composition.

The ingredients of the particular vehicle in which the resin may be dissolved or dispersed are not critical to the present invention. Thus, the conductive compositions may be water based or water miscible (including water dispersible), solvent based, plastisol based, ultraviolet based, etc.

Optionally, conductive compositions may include selected amounts of colorant which will impart a desired color thereto. As used herein, the term "colorant" is intended to include any substance that imparts color to a material. The colorant may comprise a dye or a pigment. Further, the colorant may be naturally present, admixed with a material such as dried pigments and paints, or applied in a solution such as organic dyes. For the purpose of the present invention, no distinction exists between the terms "dyes" and "pigments". Those terms will therefore be considered synonymous with each other and with the term colorant as used herein.

Examples of suitable pigments include inorganic pigments such as metal oxides, including iron, titanium, zinc, cobalt and chromium oxides. Earth colored pigments may also be used to impart colors such as siennas, ocras and umbras. Lead based pigments such as lead chromates can also be used. Organic pigments may be used including animal-based compounds such as rhodopsin and melanin. Organic vegetable derived pigments include chlorophyll, xanthophyll, litmus, flavon and carotene. Mineral pigments and synthetic pigments such as phthalocyanine, lithols, toluidene, para red toners, lakes and the like may also be used. Useful pigments are also set forth in *The Condensed Chemical Dictionary,* $8^{th}$ Edition, Van Nostrand Rheinhold (p. 695). Other useful dyes are listed in The Condensed Chemical Dictionary at page 338. Examples of well known natural dyes include madder, cochineal, logwood and indigo. Synthetic organic dyes may also be used. These dyes may be soluble in water or organic solutions. Other useful colorants that may be used in connection with the present invention include nitrodyes, amino ketone dyes, ketone-imine dyes, methine dyes, nitrodiphenyl dyes, amine dyes, quinoline dyes, aminonaphthoquinone dyes, coumarin dyes and anthraquinone dyes as well as azo dyes such as monoazo dyes and disazo dyes. Other dyes include indigold and anthraquinoid dyes.

Many other colorants other than those listed hereinabove may be used within the scope of the present invention. In one preferred embodiment, conductive compositions 22 may be substantially colorless. These substantially colorless or clear conductive compositions are also known as water white conductive compositions as they are substantially invisible as opposed to a material that has a certain opacity or color associated with it. It may be desirable for the conductive compositions 22 to be clear in the embodiment of FIGS. 1–4 so that there will be little or no effect on the intended color of the design 16. If dark colored conductive compositions were used, they may be visible through the front fabric 14 of the interactive pillow 12 and may thus interfere with the intended appearance of the baseball field design 16. Alternatively, the conductive compositions 22 may be selected from other colors that do not interfere with the intended appearance of the design 16.

In a preferred embodiment, the conductive composition 22 will be applied by screen printing. When performing screen printing procedures, any size screen mesh can be used. In a preferred embodiment, the mesh may result in the production of 110 threads per inch (i.e., 110 mesh). Other screen meshes between 16T monofilament polyester mesh to stainless steel 500 mesh can be used. Various screen tensions can be used although in a preferred embodiment, a screen tension of about 25 newtons/$cm^2$ can be used.

The conductive composition 22 may be coated directly on the inner surface 20 of the first fabric portion 12 by various known coating techniques. For example, the conductive composition 22 may be applied by knife coating, blade coating, air knife coating, reverse roll coating, gravure coating, transfer coating, roll coating, hot melt coating, spray coating, calendaring, saturation, vacuum metalizing, laminating, dipping extrusion, electrodeposition, powder coating techniques, screen printing—flat and rotary, lithography, offset printing, letterpress, flexography, pad printing, transfer printing, ink jet printing, thermography, xerography, decal application methods, hot stamping, embossing, or other methods of applying surface coating beside those set forth above. Optionally, it may be desirable to perform a drying procedure after the conductive composition 22 is applied to the inner surface 20 of the first fabric portion 12.

Although not shown in FIGS. 1–4, the conductive composition 22 may be printed on another ink or coating that is applied directly to the surface of the fabric article.

Although there is no restriction on the resistivity (or conversely conductivity) of the conductive composition 22, the resistance will preferably be between about 3 milli-ohms to 20 mega-ohms, and more preferably between about 10 milli-ohms to 500 kilo-ohms. The thickness of the conductive composition 22 may also vary substantially and although there is no restriction within the scope of the present invention, a preferred embodiment may include a conductive composition deposited to a thickness of between about 1 micron and 1000 microns.

A spacing substrate 24, made of fabric, paper, cardboard, a polymer or any other substantially nonconductive material, may be arranged beneath the inner surface 20 of the first fabric portion 12. This feature of the present invention is shown in FIGS. 2–4. However, alternate embodiments of the present invention need not include a separate spacing substrate. For example, pressure sensitive conductive compositions can be used so that direct contact between the conductive composition areas 22 and a printed circuit pattern 30 will only activate an associated circuit component when a sufficient pressure is applied.

In the embodiment of FIGS. 1–4, the spacing substrate 24 includes four openings 26 arranged in registration (i.e., alignment) with the conductive composition areas 22. As noted above, the conductive composition areas 22 are, in turn, registered with the bases 18 of the design. 16.

A substrate 28, on which a printed circuit pattern 30 is arranged is placed below the spacing substrate 24. The substrate 28 may be made of known flexible or rigid printed circuit board materials or various other nonconductive materials such as fabric, polymeric materials, fiberglass, etc. As discussed further below, certain portions of the printed circuit pattern 30 are arranged in alignment with the openings 26, the conductive composition areas 22 and corresponding bases 18.

As illustrated in FIGS. 3 and 4, the substrate 28 may also retain other portions and components of an electrical system used as part of the interactive pillow of FIGS. 1–4. In particular, a battery 32 is shown schematically connected to a circuit component 34, such as a sound chip or LED, transmitter, receiver, capacitor, inductor, resister, etc. As used herein, the term "battery" is intended to cover any internal or external power source including dc and ac power sources. The circuit component 34 can comprise any isolated circuit or a self contained integrated circuit. Certain of the printed circuit pattern 30 are connected to the circuit component 34 and the battery 32 while other leads of the printed circuit pattern 30 are connected to ground 36.

Spaces 38 are arranged between selected leads of the printed circuit pattern 30 connected to the battery 32 (i.e., the hot leads) and other leads of the printed circuit pattern 30 that are normally connected directly to ground 36 (i.e., the neutral leads). Alternatively, each of the spaces 38 can be arranged between two hot leads, and a separate path to ground may be created upon closing of the circuit. However, for the remainder of this specification, only the preferred embodiment will be described where the spaces 38 are arranged between hot and neutral leads. As best shown in FIGS. 2–4, the spaces 38 between the hot and neutral leads are also in registration with the openings 26 in the spacing substrate 24, the conductive composition areas 22 and the bases 18. The spacing substrate 24 will assure that the open circuit will normally remain open between the hot and neutral leads of the printed circuit pattern 30 so that the associated circuit component 34 can be selectively activated when a force is applied to selected touch points (i.e., the bases 18) of the baseball field design 16 as discussed further below.

The interactive pillow 10 may also include a foam support 40 and a rear fabric portion 42 connected at its periphery to the periphery of the first fabric portion 12 externally, the interactive pillow 10 may appear to be conventional as there is no need for visible wires or circuitry to enable the interactive ability of the present invention.

For the purpose of describing the operation of the interactive pillow 10, the circuit component 34 will be described as a sound chip where desired sounds can be produced upon pressing any of the four bases 18. For example, if a user presses downwardly on first base 18, the applied force will cause the underlying conductive composition area 22 to extend through the opening 26 of the spacing substrate 24 and into contact with the hot and neutral leads of the printed circuit pattern 30 across the space 38 corresponding with first base 18. Current will then be permitted to flow from the battery 32 through a selected portion of the sound chip 34 to ground 36. The selected portion of the sound chip 34 will produce a desired sound response such as "you hit a single" or the like. Similarly, if a user depresses second base 18, the sound chip 34 may be activated as current flows from the battery 32 through the corresponding selected circuit portion so that a sound such as "you hit a double" is produced. In like fashion, depressing third base 18 may generate a sound response such as "a stand up triple," while depressing home base 18 may produce the audible response "great hit, home run!"

While a spacing substrate 24 having openings 26 therein is used to maintain the conductive composition portions 22 spaced from bridging the hot and neutral circuit leads of printed circuit pattern 30 when the interactive pillow is in a normal undisturbed position, it should be appreciated that various other spacing devices may be used in other embodiments of the present invention. Regardless of the type of spacing device used, unless pressure sensitive conductive compositions are used, it is important that the conductive composition 22 be normally spaced from the hot and neutral leads of the printed circuit pattern 30 so that the spaces 38 between such leads maintain an open circuit condition until a sufficient force is applied to activate the circuit component 34.

The spaces 38 between the hot and neutral leads of the printed circuit pattern 30 may vary widely within the scope of the present invention. In a preferred embodiment, the spaces 38 between the hot and neutral leads of the printed circuit pattern 30 may be one millimeter or greater, and preferably is greater than three millimeters. However, the spaces 38 may be less than one millimeter in alternate embodiments.

Figure 5:
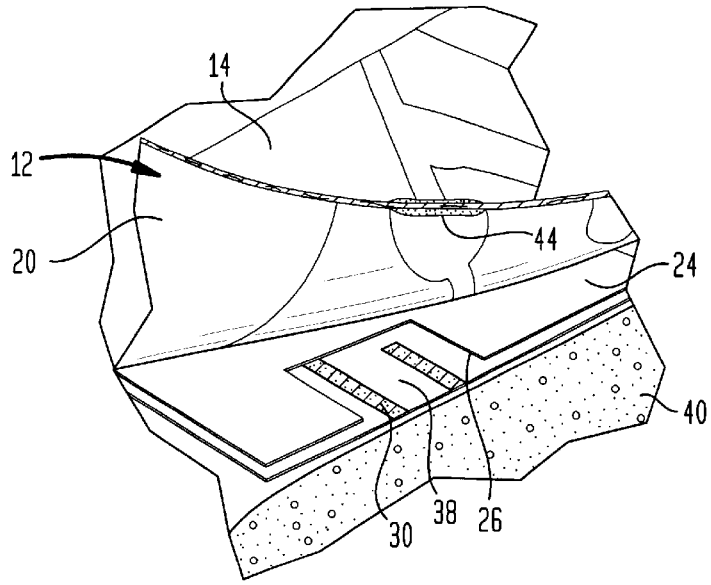
FIG. 5 is an isolated partially cut away, cross sectional and peeled open view of a second embodiment of an interactive pillow similar to the embodiment shown in FIGS. 1–4.

Another embodiment of the present invention is shown in FIG. 5. This alternate embodiment is substantially identical to the embodiment shown in FIGS. 1–4. Thus, whenever possible identical reference numerals have been used to illustrate various components and portions of the present invention. The difference between the embodiment of FIG. 5 and that of FIGS. 1–4 is that the conductive composition 44 is impregnated through the first fabric portion 12. Thus, the conductive composition 44 is present on the outer surface 14 as well as the inner surface 20 of the first fabric portion 12. In the embodiment of FIGS. 1–4, the conductive composition is designated by reference numeral 22 and is only arranged on the inner surface 20 of the first fabric portion 12.

The conductive composition 44 may have the same features as conductive composition 22. The embodiment of FIG. 5 may utilize sheer fabrics, or highly absorbent fabrics that allow conductive composition 44 to easily penetrate from the outer surface 14 to the inner surface 20 thereof.

Figure 6:
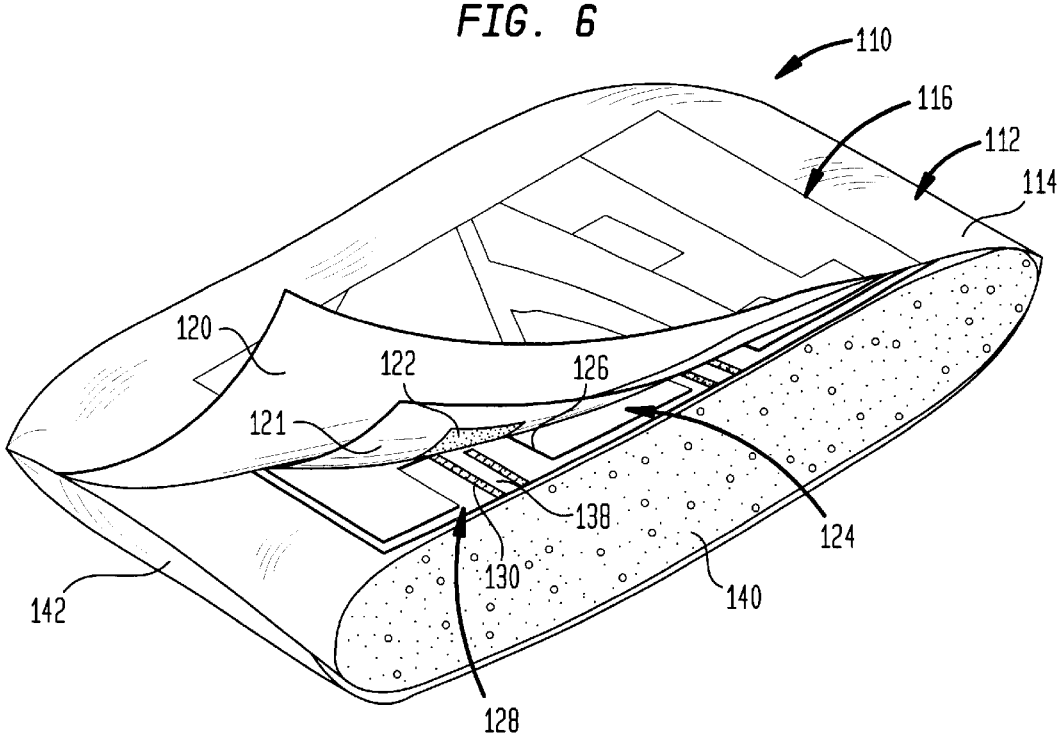
FIG. 6 is a partially cut away, cross sectional and peeled open view of a third embodiment of an interactive pillow.
Figure 7:
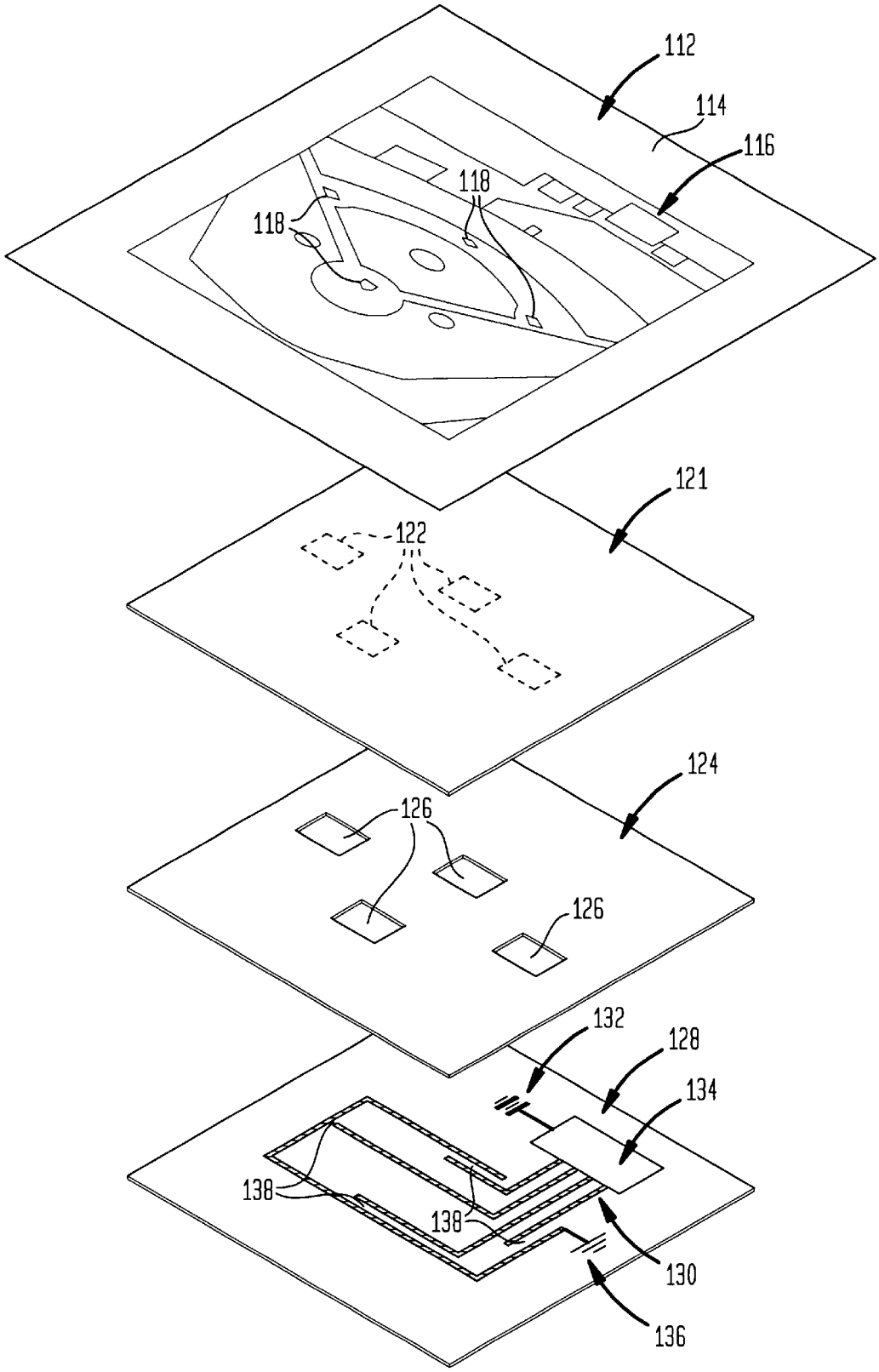
FIG. 7 is a partially exploded view of selected portions of the interactive pillow of FIG. 6.
Figure 8:
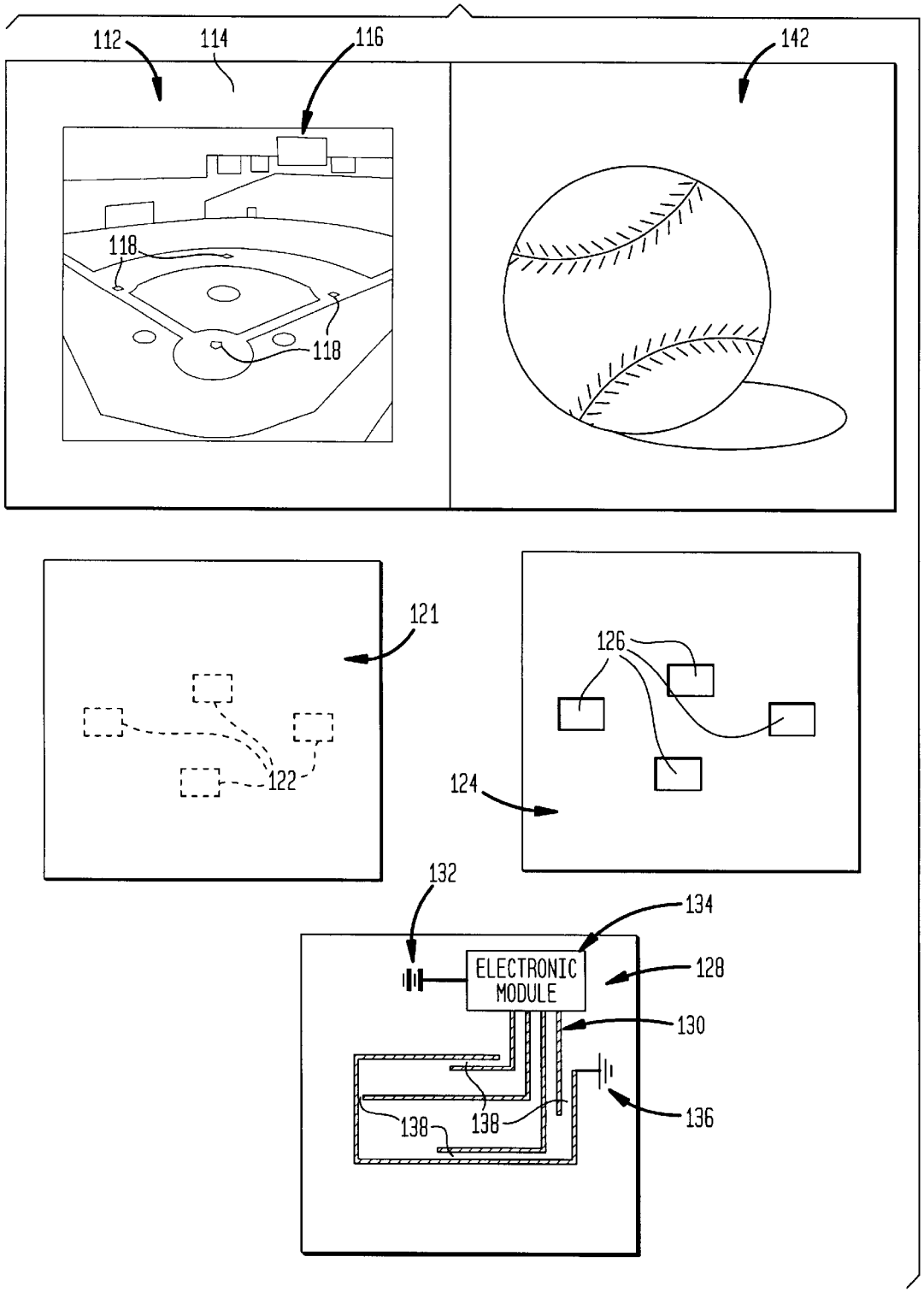
FIG. 8 is a top plan schematic view of portions of the interactive pillow embodiment of FIGS. 6 and 7.

A third embodiment of the present invention is illustrated in FIGS. 6–8. This third embodiment is similar to the first embodiment of FIGS. 1–4 and the second embodiment of FIG. 5 in that it requires registration between a portion of the design 16 on the outer surface of a pillow and conductive composition areas and with a normally open printed circuit pattern inside the pillow. As various features of the embodiment shown in FIGS. 6–8 are similar or identical to those shown in FIGS. 1–4, like reference numerals have been used wherever possible preceded by the numeral 1 to distinguish the components from the embodiment of FIGS. 1–4.

The difference between the embodiment of FIGS. 6–8 and the embodiments of FIGS. 1–4 and 5 is that an insert sheet 121 is arranged between the first fabric portion 112 and the spacing substrate 124. Conductive composition areas 122 are arranged on the lower surface of the insert sheet 121.

The insert sheet 121 may be made of fabric or various other materials such as polymers, fiberglass, paper, other cellulosic materials and the like. However, the insert sheet 121 can be made of other materials while remaining within the scope of the present invention.

One advantage of the embodiment shown in FIGS. 6–8 is that it is relatively easy to print the conductive composition 122 on the separate insert sheet 121, as opposed to printing directly on the inner surface 120 of the front fabric portion 112. Thus, while the embodiment of FIGS. 6–8 may include the additional material of insert sheet 121, production costs may be sufficiently lower than the embodiment of FIGS. 1–4 so that the cost of the insert sheet 121 is justified. As with the earlier embodiments, it is significant that in the embodiment of FIGS. 6–8, alignment is maintained between the bases 118, corresponding conductive composition areas 122, openings 126 and the spaces 138 between the hot and neutral leads of the printed circuit pattern 130. In still further embodiments, the entire surface or substantially the entire surface, of the insert sheet 121 can be coated with conductive composition so that precise registration between the conductive composition areas 122 and openings 126 of the insert sheet 121 is not required.

While the foregoing description and figures are directed toward preferred embodiments of the present invention, it should be appreciated that numerous modifications can be made to various structural features and materials of the present invention. Indeed, such modifications are encouraged to be made to the present interactive fabric article without departing from the spirit and scope of the invention. Thus, the foregoing description of the preferred embodiments should be taken by way of illustration rather than by way of limitation as the present invention is defined by the claims set forth below.

What is claimed is:

1. An interactive pillow comprising:

A first fabric portion having an outer surface and an inner surface;

a design arranged on said outer surface of said first fabric portion;

a substrate including a printed circuit pattern normally spaced from said first fabric portion;

a battery connected to said printed circuit pattern;

a circuit component connected to said printed circuit pattern; and conductive composition arranged directly on said inner surface of said first fabric portion and said inner surface of said first fabric portion between said printed circuit pattern, said conductive composition being arranged in registration with said design and with said printed circuit pattern so that a force applied to said design will cause contact between said conductive composition and said printed circuit pattern whereby current will flow from said battery through said printed circuit pattern to activate said circuit component.

2. The interactive pillow of claim 1 wherein said substrate comprises a second fabric portion.

3. The interactive pillow of claim 1 wherein said conductive composition comprises conductive ink.

4. The interactive pillow of claim 1 wherein said conductive composition on said inner surface of said first fabric portion underlies said design arranged on said outer surface.

5. The interactive pillow of claim 1 wherein said conductive composition is substantially colorless.

6. The interactive pillow of claim 1 wherein said conductive composition has a substantially black color.

7. The interactive pillow of claim 1 further comprising an insert arranged between inner surface of said first fabric portion and said printed circuit pattern of said substrate.

8. The interactive pillow of claim 7 wherein said conductive composition is arranged on said insert.

9. The interactive pillow of claim 8 wherein said insert comprises fabric.

10. The interactive pillow of claim 1 further comprising a spacing substrate arranged between said inner surface of said first fabric portion and said substrate carrying said printed circuit pattern thereon, said spacing substrate having at least one opening in registration with a selected portion of said printed circuit pattern and said conductive composition.

11. The interactive pillow of claim 10 wherein said spacing substrate comprises fabric.

12. The interactive pillow of claim 10 wherein said spacing substrate comprises cured ink.

13. The interactive pillow of claim 1 wherein said printed circuit pattern comprises conductive composition.

14. A fabric article comprising:

a first fabric portion having an outer surface and an inner surface;

a design arranged on said outer surface of said first fabric portion;

a substrate including a printed circuit pattern normally spaced from said first fabric portion;

a battery connected to said printed circuit pattern;

a circuit component connected to said printed circuit pattern;

conductive composition arranged directly on said inner surface of said first fabric portion between said inner surface of said first fabric portion and said printed circuit pattern, said conductive composition begin arranged in registration with said design and said printed circuit pattern so that a force applied to said design will cause contact between said conductive composition and said printed circuit pattern whereby current will flow from said battery through said printed circuit to actuate said circuit component.

15. The fabric article of claim 14 wherein said substrate comprises a second fabric portion.

16. The fabric article of claim 14 wherein said conductive composition comprises conductive ink.

17. The fabric article of claim 14 wherein said conductive composition on said inner surface of said first fabric portion underlies said design arranged on said outer surface.

18. The fabric article of claim 17 wherein said conductive composition is substantially colorless.

19. The fabric article of claim 14 further comprising an insert arranged between inner surface of said first fabric portion and said printed circuit pattern of said substrate.

20. The fabric article of claim 19 wherein said conductive composition is arranged on said insert.

21. The fabric article of claim 20 wherein said insert comprises fabric.

22. The fabric article of claim 14 further comprising a spacing substrate arranged between said inner surface of said first fabric portion and said substrate carrying said printed circuit pattern thereon, said spacing substrate having at least one opening in registration with a selected portion of said circuit pattern and said conductive composition.

23. The fabric article of claim 22 wherein said spacing substrate comprises fabric.

24. The fabric article of claim 22 wherein said spacing substrate comprises cured nonconductive ink.

25. The fabric article of claim 14 wherein said printed circuit pattern comprises conductive composition.

26. A fabric article comprising:

a first fabric portion having an outer surface and an inner surface;

a substrate including a printed circuit pattern;

a battery connected to said printed circuit pattern;

a circuit component connected to said printed circuit pattern; and conductive composition arranged directly on said inner surface of said first fabric portion between said inner surface of said first fabric portion and said printed circuit pattern so that a force applied to said outer surface of said first fabric portion will cause sufficient contact between said conductive composition and said printed circuit pattern whereby current will flow from said battery through said printed circuit to actuate said circuit component.

27. An interactive pillow comprising:

A first fabric portion having an outer surface and an inner surface;

a design arranged on said outer surface of said first fabric portion;

a substrate including a printed circuit pattern normally spaced from said first fabric portion;

a battery connected to said printed circuit pattern;

a circuit component connected to said printed circuit pattern; and conductive composition arranged between said inner surface of said first fabric portion and said printed circuit pattern, said conductive composition is arranged on said outer surface of said first fabric portion and is impregnated through said first fabric portion to said inner surface, and is arranged in registration with said design and with said printed circuit pattern so that a force applied to said design will cause contact between said conductive composition and said printed circuit pattern whereby current will flow from said battery through said printed circuit pattern to activate said circuit component.

28. An interactive pillow comprising:

A first fabric portion having an outer surface and an inner surface;

a design arranged on said outer surface of said first fabric portion;

a substrate including a printed circuit pattern normally spaced from said first fabric portion;

a battery connected to said printed circuit pattern;

a circuit component connected to said printed circuit pattern;

conductive composition arranged between said inner surface of said first fabric portion and said printed circuit pattern, said conductive composition being arranged in registration with said design and with said printed circuit pattern so that a force applied to said design will cause contact between said conductive composition and said printed circuit pattern whereby current will flow from said battery through said printed circuit pattern to activate said circuit component; and a spacing substrate arranged between said inner surface of said first fabric portion and said substrate carrying said printed circuit pattern thereon, said spacing substrate having at least one opening in registration with a selected portion of said printed circuit pattern and said conductive composition, said spacing substrate comprising fabric or cured ink.

29. A fabric article comprising:

a first fabric portion having an outer surface and an inner surface;

a design arranged on said outer surface of said first fabric portion;

a substrate including a printed circuit pattern normally spaced from said first fabric portion;

a battery connected to said printed circuit pattern;

a circuit component connected to said printed circuit pattern;

conductive composition arranged between said inner surface of said first fabric portion and said printed circuit pattern, said conductive composition is arranged on said outer surface of said first fabric portion and is impregnated through said first fabric portion to said inner surface, and is arranged in registration with said design and said printed circuit pattern so that a force applied to said design will cause contact between said conductive composition and said printed circuit pattern whereby current will flow from said battery through said printed circuit to actuate said circuit component.

30. The fabric article of claim 29 wherein said impregnated conductive composition has a substantially black color.

31. A fabric article comprising:

a first fabric portion having an outer surface and an inner surface;

a design arranged on said outer surface of said first fabric portion;

a substrate including a printed circuit pattern normally spaced from said first fabric portion;

a battery connected to said printed circuit pattern;

a circuit component connected to said printed circuit pattern;

conductive composition arranged between said inner surface of said first fabric portion and said printed circuit pattern, said conductive composition being arranged in registration with said design and said printed circuit pattern so that a force applied to said design will cause contact between said conductive composition and said printed circuit pattern whereby current will flow from said battery through said printed circuit to actuate said circuit component; and a spacing substrate arranged between said inner surface of said first fabric portion and said substrate carrying said printed circuit pattern thereon, said spacing substrate having at least one opening in registration with a selected portion of said circuit pattern and said conductive composition, said spacing substrate comprising fabric or cured nonconductive ink.

* * * * *

UNITED STATES PATENT AND TRADEMARK OFFICE

CERTIFICATE OF CORRECTION

PATENT NO. : 6,311,350 B1
DATED : November 6, 2001
INVENTOR(S) : Terrance Z. Kaiserman and Keith J. Margolin It is certified that error appears in the above-identified patent and that said Letters Patent is hereby corrected as shown below:

Column 9,
Line 57, "begin" should read -- being --.

Signed and Sealed this

Ninth Day of April, 2002

*Attest:*

*Attesting Officer*

JAMES E. ROGAN
*Director of the United States Patent and Trademark Office*